US005342050A

United States Patent [19]

Thompson

[11] Patent Number: 5,342,050

[45] Date of Patent: Aug. 30, 1994

[54] BOARD GAME WITH AIR-CUSHIONED FLOATING PUCKS

[75] Inventor: Robert C. Thompson, Palo Alto, Calif.

[73] Assignee: Monneret Jouets, Lons-le-Saunier, France

[21] Appl. No.: 931,015

[22] Filed: Aug. 17, 1992

[51] Int. Cl.[5] ..... A63F 3/00

[52] U.S. Cl. ..... 273/126 R; 273/128 R

[58] Field of Search ..... 273/126 R, 126 A, 128 R, 273/128 CS, 128 A, 424

[56] References Cited

U.S. PATENT DOCUMENTS

| | | | |
|---|---|---|---|
| 483,895 | 10/1892 | Buckley . | |
| 2,159,966 | 5/1939 | Dunham . | |
| 2,425,966 | 8/1947 | Tjomsland | 273/128 R |
| 2,467,043 | 4/1949 | Kotler | 273/128 R |
| 2,600,856 | 6/1952 | Decepoli | 273/128 R |
| 2,606,030 | 8/1952 | Tjomsland | 273/128 R |
| 2,673,637 | 3/1954 | Collins et al. | 273/128 R |
| 3,726,526 | 4/1973 | Radovich | 273/128 R |
| 3,773,325 | 11/1973 | Crossman et al. . | |
| 3,797,057 | 3/1974 | Smelden | 273/128 R |
| 3,913,918 | 10/1975 | Trachtman . | |
| 3,927,885 | 12/1975 | Crossman et al. | 273/126 R |
| 3,931,974 | 1/1976 | Goldfarb et al. | 273/126 R |
| 4,000,900 | 1/1977 | Lehmann . | |
| 4,283,054 | 8/1981 | Patella et al. . | |
| 4,463,954 | 8/1984 | Panse et al. . | |

*Primary Examiner*—Vincent Millin
*Assistant Examiner*—Raleigh W. Chiu
*Attorney, Agent, or Firm*—Oliff & Berridge

[57] ABSTRACT

Disclosed is a board game for two players that includes a flat, smooth playing surface (10), a round puck (16), two round bats (15 and 15') and two goals (17 and 17'). A rail (12) borders the playing surface to keep the puck on the playing surface. The aim of each player is to strike the puck with a bat into the opponent's goal, while blocking the puck from entering his/her own goal. The extremely light weight puck, which has a diameter of 64 mm and a thickness of 1 mm, has the shape of an extremely shallow, inverted cone with the side (18) having an angle of 0.3 degree. When the puck is struck by a bat, air rushing against the underside of the cone-shaped puck lifts the puck completely off the playing surface, such that the puck glides on a thin cushion of air. Because the puck travels across the playing surface without friction against the surface, the puck can maintain very high speeds to greatly challenge the dexterity and reaction of the players as they try to strike or block the fast moving puck.

15 Claims, 2 Drawing Sheets

BOARD GAME WITH AIR-CUSHIONED FLOATING PUCKS

BACKGROUND

1. Field of Invention

This invention relates generally to games and in particular to board games having fast moving playing pieces.

2. Prior Art

Board or table games with fast moving playing pieces, such as table hockey, have been popular for many years. These games generally require the two players to strike a flat disc or puck, using striking pieces, across a smooth playing surface. Each player aims to propel the puck into the opponent's goal and to prevent the puck from entering his/her own goal. Ideally, the puck should move at a high velocity after being struck so as to challenge the opposing players' dexterity and reflexes as they try to strike or intercept the puck. In addition, the entire game apparatus should be simple and economical.

Many board or table games incorporating moving discs have been designed in the past. U.S. Pat. No. 3,913,918 to Trachtman (1975) shows a table hockey game with multiple pucks. The pucks make full contact with the table, creating high frictional drag. Therefore, the pucks slow down substantially as they travel across the playing surface.

Some games have been designed to maintain high puck speed by reducing or eliminating friction between the puck and the board or table. U.S. Pat. Nos. 483,895 to Buckley (1892), 2,159,966 to Dunham (1939), and 4,000,900 to Lehman (1977) show games with playing pieces which have concave lower surfaces intended for minimizing sliding friction, and thus minimizing deceleration. In actuality, the weight of the pucks is simply redistributed on a far smaller area. Therefore total friction remains the same, so that deceleration is not minimized. U.S. Pat. No. 4,283,054 to Patella et al. (1981) shows playing pieces with multiple concavities on the lower surface, and a central point which raises the lower surface of the playing piece slightly off the playing surface. In actual play, the playing piece does achieve some degree of friction reduction. However, sufficient friction still remains to cause significant deceleration.

The only table game with a puck which moves without friction with the playing surface is shown in U.S. Pat. No. 3,773,325 to Crossman et al. (1973). Air is forced by motorized means through hundreds of tiny holes on the playing surface to lift the playing piece completely off the surface. Thus the playing piece, after being struck by a player, does not decelerate appreciably as it travels across the table. Although effective, this system is large and expensive, since a pump blower and complex tubing and holes are required to force air through the holes.

Aside from table or board games, fast moving discs were also designed for use on other surfaces. U.S. Pat. No. 4,463,954 to Panse (1984) shows an aquatic surface skimmer incorporating a lower surface with an inverted, frusto-conical shape to allow the projectile to skim smoothly across the surface of a body of water. Because the large skimmer, which weights 62 to 168 grams, relies on hydrodynamic lift, it must remain in contact with the water during its travel. It is not capable of floating on a cushion of air without touching the water.

In conclusion, previous designs of games with fast moving discs either cannot eliminate disc/playing surface friction, or can only do so at high cost.

OBJECTS AND ADVANTAGES

Accordingly, several objects and advantages of the invention are to provide a board game with a fast moving playing piece which challenges the dexterity and reflex of the players, which uses a playing piece that moves across the playing surface at high speed without contacting the playing surface during its travel, which provides goals for receiving and stopping the playing pieces, which may be compacted for convenient transportation and storage, and which is very simple and economical in construction.

Further objects and advantages will become apparent from a study of the following description and the accompanying drawings.

DRAWING FIGURES

DESCRIPTION—FIG. 1—GAME

Figure 1:
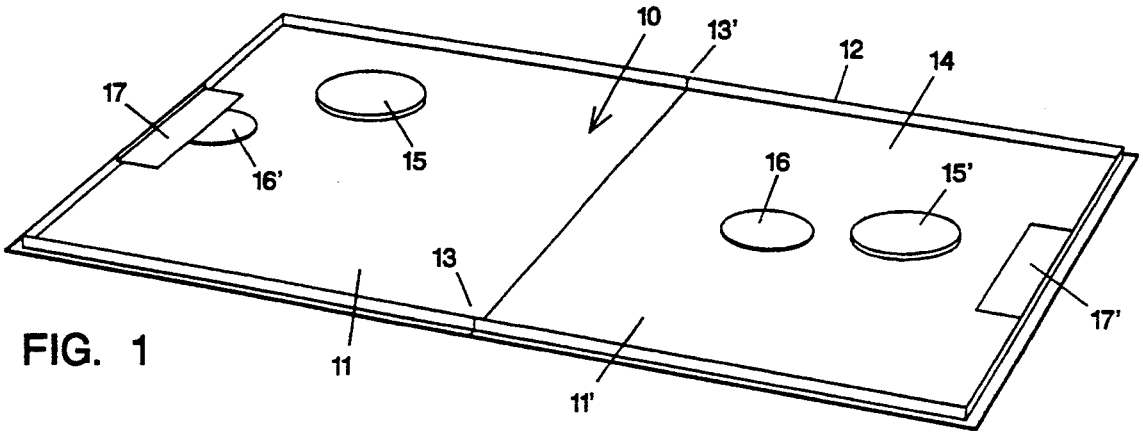
FIG. 1 is a perspective view of the board game with air cushioned puck in accordance with the invention.

In accordance with a preferred embodiment of the invention shown in the perspective view in FIG. 1, a board game with air-cushioned puck has a flat, smooth, playing surface on board 10. Board 10 is generally rectangular, and is made of a heavy gauge masonite which resists flexing to maintain flatness. Board 10 is covered with a glassy smooth liner 14, which is printed with attractive, multi-color graphics. Board 10 is composed of two linked portions, halves 11 and 11'. A low rail 12, which is attached to and borders board 10, has breaks 13 and 13' at the junction between halves 11 and 11'. Board 10 is 110 cm long and 81.2 cm wide.

On the surface of board 10 are bats 15 and 15', and puck 16. Bats 15 and 15' are flat, round discs with a thickness of 1.5 mm and a diameter of 100 ram. Goals 17 and 17' are flat, rectangular plates attached to the mid-portions of the short sides of rail 12. Bats 15 and 15' are used by two players to attempt to strike puck 16 into their opponent's goal 17 or 17', or to block puck 16 from entering their own goals. FIG. 1 illustrates a puck 16' caught under goal 17.

DESCRIPTION—FIGS. 2A AND 2B—PUCK WITH CONICAL SHAPE

Figure 2A:
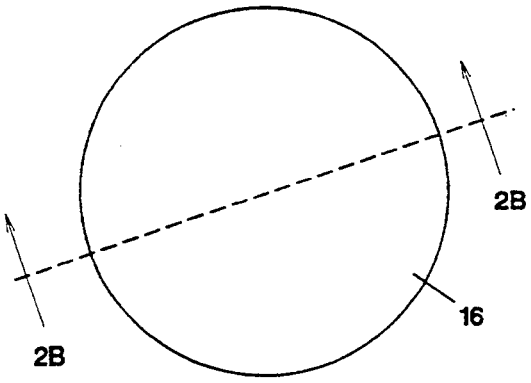
FIG. 2A is a top view of the puck of FIG. 1.

Puck 16 is shown in FIG. 2A in a top view. Puck 16 is a round, very light weight plastic disc with a thickness of 1 mm and a diameter of 63 mm. It weights about 2.5 grams.

Figure 2B:
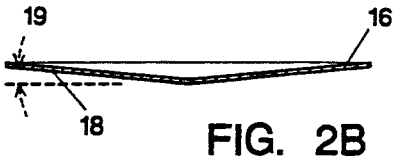
FIG. 2B is a radial sectional view of the puck of FIG. 2A.

FIG. 2B shows puck 16 in a radial sectional view, taken as indicated by lines 2B—2B of FIG. 2A. Puck 16 has the cross section of a very shallow, inverted cone.

The bottom radial surface or side 18 of the cone has an angle 19 of between 0.1 degree and 3.0 degrees, preferably 0.3, degree with the horizontal or imaginary plane parallel to the puck.

Figure 5:
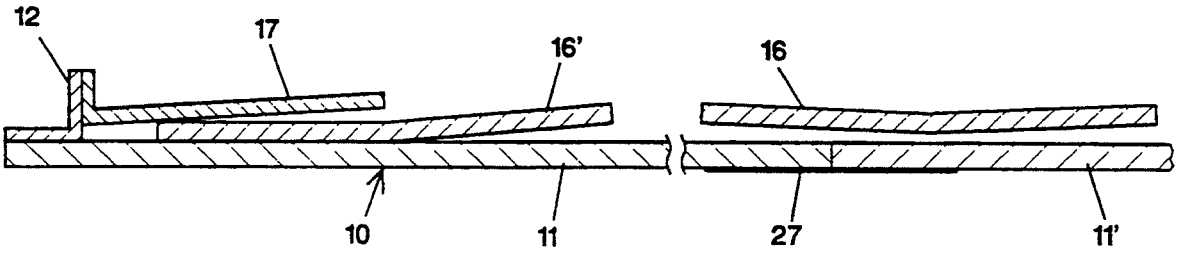
FIG. 5 is a side sectional view of the game of FIG. 1.
Figure 6:
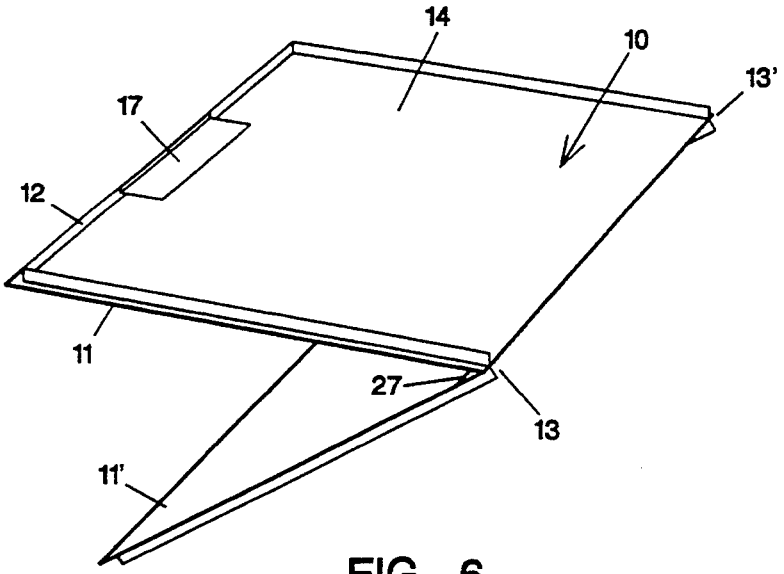
FIG. 6 is a perspective of the board being folded.

When puck 16 is given a sufficient initial horizontal velocity, such as when struck moderately hard by the edge of bat 15, air rushing against the leading side 18 will lift puck 16, which is very light weight, completely off the surface of board 10 (FIG. 1 ). Puck 16 thus flies or floats across board 10 (FIG. 5) on a very thin cushion of air, without touching the board. Because friction between puck 16 and board 10 (FIG. 1) is eliminated, puck 16 can maintain a very high velocity during its travel, which greatly challenges the dexterity and reaction of the players as they try to hit or block puck 16.

DESCRIPTION—FIGS. 3A AND 3B—W-SHAPED PUCK

Figure 3A:
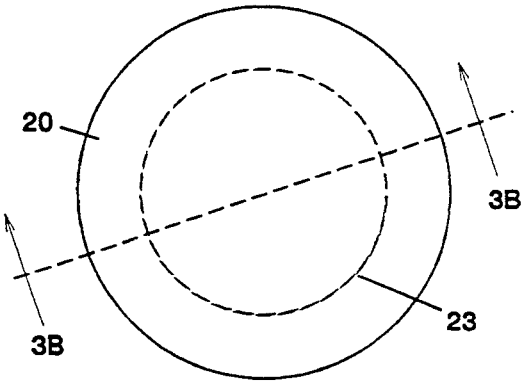
FIG. 3A is a top view of an alternative embodiment of the puck of FIG. 1.
Figure 3B:
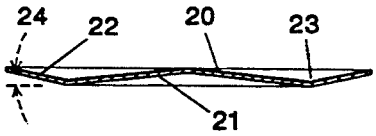
FIG. 3B is a radial sectional view of the puck of FIG. 3A.
Figure 4:
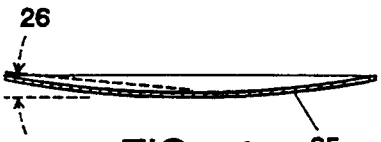
FIG. 4 is a radial sectional view of another embodiment of the puck of FIG. 1.

FIG. 3A shows a puck 20, an alternative embodiment of the playing piece, in a top view. Puck 20 has the same thickness and diameter as puck 16. Referring to FIG. 3B, a radial sectional view of puck 20, taken along line 3B—3B of FIG. 3A. The puck has an upright concavity 21 at its center, which extends out to ⅔ of the puck's radius. An upturned flange 22 or circumferential portion extends from the edge of concavity 21 out to the perimeter of puck 20. The cross section of puck 20 thus forms a very shallow "W". The junction between concavity 21 and flange 22 forms a groove 23. Concavity 21 is 1 mm high, while flange 22 has an angle 24 of between 0.2 degree and 10 degrees, preferably 1 degree, (shown exaggerated).

When puck 20 is given a sufficient initial velocity, air rushing against the leading side of range 22 lifts the lightweight puck off board 10 (FIG. 1 ). Air trapped under concavity 21 helps to maintain the air cushion over which puck 20 travels.

DESCRIPTION—FIG. 4—PUCK WITH AN INVERTED DOME SHAPE

Here another embodiment of the playing piece, puck 25, is shown in radial sectional view. The cross section of puck 25 is an upturned, shallow arc. The angle 26 between the edge portion of puck 25 and the center of the disc is 0.6 degree. Puck 25 works in a manner similar to puck 16 (FIGS. 2A and 2B).

DESCRIPTION—FIG. 5—BOARD IN PLAY

Here board 10, rail 12, goal 17, and disc 16' are shown in a side sectional view. Rail 12 is a plastic "L" beam substantially higher than the thickness of puck 16. Goal 17, which is attached to the inside of rail 12, is also an "L" beam, but has very long lower leg angled upwardly at its distal end. Goal 17 is mounted such that the narrowest portion of the gap between goal 17 and board 10 is slightly less than the thickness of puck 16', such that puck 16' will be caught under goal 17 when it flies thereunder. A flexible fabric hinge 27 is glued to the underside of the junction of halves 11 and 11' to allow the halves to be folded together. Puck 16, having been given a horizontal velocity by bat 15 (FIG. 1), is floating across board 10 on a thin cushion of air.

DESCRIPTION—FIG. 6—FOLDED BOARD

Here the game is shown, in a perspective view, being folded in half about the junction between halves 11 and 11' for easy transportation and storage.

SUMMARY, RAMIFICATIONS, AND SCOPE

Accordingly the reader will see that I have provided an improved board game with an air cushioned puck which two opposing players attempt to strike into their opponent's goal. The puck is shaped such that it travels across the smooth board on a thin cushion of air. The puck, moving without contacting the board, can maintain very high speeds to greatly challenge the dexterity and reaction of the players as they try to hit or block the puck with bats. The board may be folded in half for easy transportation and storage. The game is extremely simple and economical to manufacture.

While the above descriptions are specific, they should not be considered as limitations on the scope of the invention, but only as examples of the preferred embodiment. Many other ramifications and variations are possible within the teachings of the invention. For example, the components may be made of different materials. The shape of board 10 may be different. Instead of being round discs, pucks 16, 20, and 25 may be of other shapes such as square, octagonal, etc. Angles 19, 24, and 26 of pucks 16, 20, and 25, respectively, as well as the sizes indicated, may be slightly different. The top of the pucks may be flat. Bats 15 and 15' may also be of different shapes, such as square, triangular, oval etc. Board 10 may be of a single piece, and therefore not foldable.

Thus the reader is requested to determine the scope of the invention by the appended claims and their legal equivalents, and not by the examples given.

I claim:

1. A game, comprising:

a horizontal surface;

a thin puck having a bottom surface that may be juxtaposed with said horizontal surface, and adapted for being given a sufficient velocity across said horizontal surface that air rushing against said bottom surface lifts said puck completely off said horizontal surface, whereby said puck travels on a thin cushion of air across said horizontal surface at high speed without frictional engagement between said horizontal surface and said puck;

a bat for striking said puck;

a raised border forming a perimeter around said horizontal surface for containing said puck within said horizontal surface; and a goal disposed above said horizontal surface within the perimeter formed by said raised border, said goal being adapted for catching said puck between said goal and said horizontal surface if said puck enters into a space between said goal and said horizontal surface.

2. The game of claim 1 wherein said bat comprises a generally flat disc having a thickness greater than said thickness of said puck.

3. The game of claim 2 wherein said goal comprises a horizontal flat plate spaced slightly above said horizontal surface, said horizontal flat plate being upwardly angled towards a central region of said horizontal surface for receiving and catching said puck.

4. The game of claim 3 wherein said goal is generally rectangular in shape.

5. The game of claim 3 wherein said puck comprises a round disc.

6. The game of claim 1 wherein said puck comprises a round disc.

7. The game of claim 6 wherein said puck comprises a plate having the bottom surface thereof formed in a convex conical shape that has an angle of between 0.1 degree and 3.0 degrees with a plane parallel to said puck.

8. The game of claim 6 wherein said puck comprises a plate having the bottom surface thereof formed as a shallow "W" radial sectional shape with a central concavity surrounded by an upwardly angled flange extending from the edge of said concavity to the perimeter of said puck, the radial portion of said upwardly angled flange making an angle of between 0.2 degree and 10 degrees with a plane parallel to said puck.

9. The game of claim 6 wherein said puck comprises a plate having the bottom surface thereof formed as an inverted dome with an upturned shallow arc cross sectional shape.

10. The game of claim 1 wherein said horizontal surface is flat and smooth and covered with a glassy smooth liner.

11. The game of claim 1 wherein said puck comprises a plate having the bottom surface thereof formed in a convex conical shape that has an angle of between 0.1 degree and 3.0 degrees with a plane parallel to said puck.

12. The game of claim 1 wherein said puck comprises a plate having the bottom surface thereof formed as a shallow "W" radial sectional shape with a central concavity surrounded by an upwardly angled flange extending from the edge of said concavity to the perimeter of said puck, the radial portion of said upwardly angled flange making an angle of between 0.2 degree and 10 degrees with a plane parallel to said puck.

13. The game of claim 1 wherein said puck comprises a plate having the bottom surface thereof formed as an inverted dome with an upturned shallow arc cross sectional shape.

14. The game of claim 1 wherein said goal comprises a horizontal flat plate spaced slightly above said horizontal surface, said horizontal flat plate being upwardly angled towards a central region of said horizontal surface for receiving and catching said puck.

15. The game of claim 14 wherein said goal is generally rectangular in shape.

* * * * *